US008033261B1

(12) United States Patent
Robbins

(10) Patent No.: US 8,033,261 B1
(45) Date of Patent: Oct. 11, 2011

(54) VALVE ACTUATION SYSTEM AND RELATED METHODS

(76) Inventor: Warren H. Robbins, Fountain Valley, CA (US)

( * ) Notice: Subject to any disclaimer, the term of this patent is extended or adjusted under 35 U.S.C. 154(b) by 344 days.

(21) Appl. No.: 12/263,823

(22) Filed: Nov. 3, 2008

(51) Int. Cl.
*F01L 1/18* (2006.01)

(52) U.S. Cl. ..... 123/90.44; 123/90.24; 123/90.39

(58) Field of Classification Search ..... 123/90.16, 123/90.39, 90.24, 90.44
See application file for complete search history.

(56) References Cited

U.S. PATENT DOCUMENTS

| | | | | |
|---|---|---|---|---|
| 577,589 | A | 2/1897 | Teubert | |
| 1,309,339 | A | 7/1919 | Reynolds | |
| 1,318,542 | A | 10/1919 | Chevrolet | |
| 1,561,544 | A | 11/1925 | How | |
| 1,671,973 | A | 6/1928 | Anderson | |
| 1,679,794 | A | 8/1928 | Smith | |
| 1,937,152 | A | 11/1933 | Junk | |
| 2,015,135 | A | 9/1935 | Brady | |
| 2,266,077 | A | 12/1941 | Roan | |
| 2,410,660 | A | 11/1946 | Howard | |
| 2,466,550 | A | 4/1949 | Lundquist | |
| 2,584,055 | A | 1/1952 | Smith | |
| 2,641,236 | A | 6/1953 | Mansfield | |
| 2,738,748 | A | 3/1956 | Hecht | |
| 2,751,895 | A | 6/1956 | Gassmann | |
| 2,773,490 | A | 12/1956 | Miller | |
| 2,824,554 | A | 2/1957 | Sampietro | |
| 2,791,206 | A | 5/1957 | Engemann | |
| 2,814,283 | A | 11/1957 | Gassmann | |
| 2,817,326 | A | 12/1957 | Taylor | |
| 2,823,655 | A | 2/1958 | Repko | |
| 2,831,470 | A | 4/1958 | Lorscheidt | |
| 2,832,327 | A | 4/1958 | Lorenz | |
| 2,833,258 | A | 5/1958 | Lorscheidt | |
| 2,851,851 | A | 9/1958 | Smith | |
| 2,858,818 | A | 11/1958 | Bailey | |
| 2,878,796 | A | 3/1959 | Mannerstedt | |
| 2,880,712 | A | 4/1959 | Roan | |
| 2,954,016 | A | 9/1960 | Leese | |
| 2,954,017 | A | 9/1960 | Forestner | |
| 3,020,018 | A | 2/1962 | Stram | |
| 3,087,479 | A * | 4/1963 | Thompson | 123/90.41 |
| 3,138,038 | A | 6/1964 | Scherenberg et al. | |
| 3,195,528 | A | 7/1965 | Franklin | |
| 3,254,637 | A | 6/1966 | Durham | |
| 3,317,179 | A | 5/1967 | Willis | |
| 3,424,024 | A | 1/1969 | Derbfuss | |
| 3,430,614 | A | 3/1969 | Meacham | |
| 3,585,974 | A | 6/1971 | Weber | |
| 3,626,469 | A | 12/1971 | Ashley | |

(Continued)

OTHER PUBLICATIONS

Neil Spalding, "Positive action: Neil Spalding assesses Ducati's continuing use of desmodromic valve actuation", Race Engine Technology, Aug. 2007, pp. 24-25, Issue 24, High Power Media, Somerset, England. (3 pgs).

(Continued)

*Primary Examiner* — Zelalem Eshete
(74) *Attorney, Agent, or Firm* — J. Mark Holland & Associates

(57) ABSTRACT

A valve actuation system in an internal combustion engine provides for, among other things, valve control in a single and dual camshaft "push rod" type engine without the use of a return spring mechanism. In one embodiment of the present invention, a single rocker link or "push rod" is operably connected to a bifurcated rocker valve for opening and closing a single valve.

5 Claims, 9 Drawing Sheets

U.S. PATENT DOCUMENTS

| | | | |
|---|---|---|---|
| 3,641,988 | A | 2/1972 | Torazza et al. |
| 3,684,237 | A | 8/1972 | Hyde et al. |
| 3,911,879 | A | 10/1975 | Altmann |
| 4,007,716 | A | 2/1977 | Jones |
| 4,036,185 | A | 7/1977 | Key |
| 4,061,115 | A | 12/1977 | Predhome, Jr. |
| 4,138,973 | A | 2/1979 | Luria |
| 4,261,307 | A | 4/1981 | Oldberg |
| 4,364,341 | A | 12/1982 | Holtmann |
| 4,382,428 | A | 5/1983 | Tourtelot, Jr. et al. |
| 4,457,268 | A | 7/1984 | Jones |
| 4,469,056 | A | 9/1984 | Tourtelot, Jr. et al. |
| 4,475,496 | A | 10/1984 | Sugahara |
| 4,495,902 | A | 1/1985 | Burandt |
| 4,530,318 | A | 7/1985 | Semple |
| 4,572,118 | A | 2/1986 | Baguena |
| 4,576,128 | A | 3/1986 | Kenichi |
| 4,594,972 | A | 6/1986 | Ma |
| 4,646,690 | A | 3/1987 | Hayashi |
| 4,662,323 | A | 5/1987 | Moriya |
| 4,671,221 | A | 6/1987 | Geringer et al. |
| 4,674,451 | A | 6/1987 | Rembold |
| 4,697,554 | A | 10/1987 | Bothwell |
| 4,711,202 | A | 12/1987 | Baker |
| 4,714,057 | A | 12/1987 | Wichart |
| 4,723,515 | A | 2/1988 | Burandt |
| 4,754,728 | A | 7/1988 | Bordi et al. |
| 4,763,615 | A | 8/1988 | Frost |
| 4,784,094 | A | 11/1988 | Bordi et al. |
| 4,805,568 | A | 2/1989 | Springer et al. |
| 4,858,573 | A | 8/1989 | Bothwell |
| 4,887,564 | A | 12/1989 | Edwards |
| 4,887,565 | A | 12/1989 | Bothwell |
| 4,898,130 | A | 2/1990 | Parsons |
| 4,901,684 | A | 2/1990 | Wride |
| 4,928,650 | A | 5/1990 | Matayoshi |
| 4,944,256 | A | 7/1990 | Matayoshi |
| 5,003,939 | A | 4/1991 | King |
| 5,016,581 | A | 5/1991 | Parsons |
| 5,048,474 | A | 9/1991 | Matayoshi |
| 5,056,476 | A | 10/1991 | King |
| 5,127,375 | A | 7/1992 | Bowman et al. |
| 5,189,998 | A | 3/1993 | Hara |
| 5,245,957 | A | 9/1993 | Bornstein et al. |
| 5,501,186 | A | 3/1996 | Hara |
| 5,680,837 | A | 10/1997 | Pierik |
| 5,732,669 | A | 3/1998 | Fischer |
| 5,732,670 | A | 3/1998 | Mote |
| 5,782,216 | A | 7/1998 | Haas et al. |
| 5,787,849 | A | 8/1998 | Mitchell |
| 5,809,951 | A | 9/1998 | Kim |
| 5,826,551 | A | 10/1998 | Janse van Vuuren |
| 5,899,180 | A | 5/1999 | Fischer |
| 5,931,130 | A | 8/1999 | Lucarini |
| 5,937,809 | A | 8/1999 | Pierik |
| 6,019,076 | A | 2/2000 | Pierik |
| 6,053,134 | A | 4/2000 | Linebarger |
| 6,109,226 | A | 8/2000 | Mote |
| 6,257,190 | B1 | 7/2001 | Linebarger |
| 6,311,659 | B1 | 11/2001 | Pierik |
| 6,378,474 | B1 | 4/2002 | Pierik |
| 6,382,150 | B1 | 5/2002 | Fischer |
| 6,422,187 | B2 | 7/2002 | Fischer |
| 6,487,997 | B2 | 12/2002 | Palumbo |
| 6,497,206 | B2 | 12/2002 | Nohara |
| 6,505,590 | B1 | 1/2003 | Rao |
| 6,619,250 | B2 | 9/2003 | Folino |
| 6,655,330 | B2 | 12/2003 | Pierik |
| 6,694,934 | B1 | 2/2004 | Preston |
| 6,705,262 | B2 | 3/2004 | Battlogg |
| 6,796,277 | B2 | 9/2004 | Battlogg |
| 6,802,287 | B2 | 10/2004 | Battlogg |
| 6,817,326 | B1 | 11/2004 | Anibas |
| 6,904,882 | B2 | 6/2005 | Battlogg |
| 6,948,468 | B1 | 9/2005 | Decuir |
| 6,953,014 | B2 | 10/2005 | Folino |
| 7,051,691 | B2 | 5/2006 | Battlogg |
| 7,077,088 | B1 | 7/2006 | Decuir |
| 7,082,912 | B2 | 8/2006 | Folino |
| 2003/0019467 | A1 | 1/2003 | Mengoli |

OTHER PUBLICATIONS http://www.shopereator.com/mall/productpage.cfm/RET/2025/111664 (1 pg).

US 2,131,755, 10/1938, Roan (withdrawn)

* cited by examiner

VALVE ACTUATION SYSTEM AND RELATED METHODS

FIELD OF INVENTION

The present invention relates generally to engines, and more particularly to a valve actuation system in an internal combustion engine. Among other things, it provides improved valve control in a "push rod" type engine, including for current and past "push rod" production engines where the valves are of a standard commercial design, so that unique valve designs or configurations are not necessary. In one embodiment, it provides this control by use of a single rocker link or "push rod" operably connected to a bifurcated valve rocker arm for opening and closing a single valve without the use of a return spring mechanism.

BACKGROUND OF INVENTION

Traditionally, four-cycle internal combustion engines have relied on a valve train having "poppet" or mushroom intake and exhaust valves to feed the combustible air fuel mixture into the cylinder(s), seal the cylinder(s) during combustion, and to expel the burned fuel air mixture. Numerous alternatives to poppet valves have been tried over the hundred plus years of internal combustion four cycle engine development (including, sleeve valves, rotary valves, and slide valves to name a few). However, the vast majority of today's engines still rely on poppet valves because of the valve's ability to provide excellent sealing at an economical cost. Although the present invention may be used in other applications, it is primarily directed at engines using poppet valves.

As indicated above, the valve train typically consists of valves and a camshaft to actuate the valves (by an opening and closing mechanism). The camshaft, typically a long round shaft, includes lobes shaped and ground into the shaft to create offset motion (lift). As the camshaft spins, the lobes open and close the intake and exhaust valves in a synchronized relationship with the motion of the piston. The camshaft can be located directly over the valves (overhead camshaft), generally between the intake and exhaust valves, in either a single or double camshaft arrangement (SOHC or DOHC). So, for example, in a SOHC engine, the engine will have one cam if the engine is an inline 4-cylinder or inline 6-cylinder. If instead the SOHC engine is a V-engine (for example, V-6 or V-8), it will have two cams (one for each cylinder head), even though each is a "single" overhead camshaft. Similarly, DOHC engines have two cams for each of the foregoing. Thus, inline DOHC engines have two cams, and V-engines have four cams. Usually, DOHC are used on engines with four or more valves per cylinder, because a single camshaft cannot fit enough lobes to actuate all of the required valves.

The cam, with attached lobe(s), typically actuates a pivoted rocker arm to push down on the corresponding valves, which "opens" the valves to allow air and fuel into the cylinder. To close the valves, at least two main approaches have been used: desmodromic, and non-desmodromic (such as springs).

For non-desmodromic valves, springs typically are used to return the valves to their closed position. It is generally desirable that the springs are very strong because at high engine speeds, the valves are pushed down very quickly, and it is the springs that keep the valves in contact with the rocker arms. If the springs were not strong enough, the valves might come away from the rocker arms and snap back. This is an undesirable situation that would result in extra wear on the cams and rocker arms, and might even cause catastrophic failure such as if the valves come into contact with the pistons.

Push-rod type engines typically are made with non-desmodromic valves, with a camshaft located in the sump near the crankshaft. Most commonly the camshaft assembly includes cam followers (commonly called "lifters") that push on tubular rods ("push rods"). The push rods push on pivoted rocker arms, which push the valve open. This "push rod" engine approach has more moving parts, and also causes more timing lag between the cam's activation of the valve and the valve's subsequent motion. A gear set, timing belt or timing chain links the crankshaft to the camshaft, so that the valves are in sync with the pistons. All of these methods of opening and closing the poppet valves in these push-rod engines require a spring (or similar action from, for example, a nitrogen/air bag) to close the valve.

Numerous problems can occur in systems that rely on springs or air bags to actuate a valve. Such problems include that valve springs in a conventional valve system are prone to harmonic forces that can cause the valves to bounce off the valve seat resulting in inadequate valve sealing and loss of engine power. Another "problem" in spring valve systems is that the high valve spring forces required in high-speed engines also mean that power is consumed to open the valves against these forces, resulting in less net power output. Accordingly, to obtain good results with a spring system, it is necessary to find a compromise between heavier spring loading required to turn at higher RPM while preventing valve bounce, and lighter spring loading to reduce the work required to open the valves against the spring loading.

In this regard, because valve springs must return the valves to their seats (sealing position), the higher the RPM the greater the kinetic force the springs must overcome, necessitating ever increasing pressures from the springs. In conventional valve system design, the design places fatigue stresses on the spring materials, resulting in failures. In the "push rod" engine design mentioned above, the springs must return to the closed position not only the valve, but also the rocker arm, push rod, and lifter. This can require spring forces at maximum opening of over 900 lbs. per spring. As such, valve spring failures are the most common failures in racing engines.

Rather than springs or air bags, desmodromic valve systems use extra cam lobes on the camshaft, with rocker arms activated by those cams that close the valves. The cams thus provide total control of the opening and closing action of the valves, rather than relying on separate spring elements for part of the valve action.

Desmodromic or spring-less valve actuation systems can reduce or eliminate the problems discussed above, and can provide control/smoothness, and consequently decreased power losses at low RPM, and reliability, without the loss of valve control at higher RPM. A few racing engines use a desmodromic valve system such as mentioned above, in which separate cam lobes control the opening and closing of the valve. Probably, the most famous were the Mercedes racing engines of the 1950s, including the legendary "Gullwing 300 SL" and today's Ducati motorcycles. These desmodromic systems used overhead camshaft designs to minimize components, weight, and space.

Desmodromic opening and closing of the valves further enhances performance by allowing cam designs of higher opening lift (the intake valve is opened to a "higher" position, so that it protrudes further into the cylinder), since they eliminate the limit of valve spring coil bind (when a coil spring(s) is compressed to the point the individual coils in the spring make contact with each other). This higher opening lift can result in greater volumetric efficiency for the engine, i.e., more air and fuel enters the cylinder for combustion, resulting in greater power output.

Another advantage of a desmodromic or spring-less valve system is that it eliminates a condition commonly referred to as "valve float", wherein the valve is not following the camshaft lobe's shape, and may come into contact with the piston or valves. Desmodromic systems likewise eliminate concerns about coil bind, bounce, and harmonics. Desmodromic cam designs can accelerate the valve opening faster, hold the valve open for a longer duration of crankshaft rotation, and close the valve faster without fear that the closing valve may be contacted by the piston. These new design parameters result in more power output from better volumetric efficiency and cylinder sealing.

Accordingly, valve control in "push rod" type engines could be improved by eliminating the use of a return spring mechanism.

Improvements or modifications involving the contact between the valve rocker arm and the end of the valve of known valve systems as a means to improving various engine characteristics has been the subject of numerous patents. Several of these solutions arguably provide the "push-pull" connection necessary for desmodromic type valve action, but the designs require that unique valves be supplied. Because the valve system of the present invention is primarily intended for current and past production engines of the "push rod" design where the valves are of a commercial design, such unique valve designs or configuration are not necessary.

There exist numerous patents for desmodromic valve systems, but few have been mass-produced because of their complexity and critical tolerances. For example, U.S. Pat. Nos. 5,732,670 and 6,109,226 (both issued to Mote, Sr.) are directed to subject matter relating to "push rod" type engines, with the '226 patent describing replacing the more conventional push rods, lifters, and cam with an overhead cam assembly incorporating the geared rocker arrangement of the '670 patent. Among other things, the Mote technology apparently purports to result in a "push rod" engine with desmodromic valves. The Mote technology apparently has several shortcomings, however, in that it teaches to use gears as a linkage to the valves, it has no reversing pivot rocker, and it uses two lifters within a single bore.

SUMMARY OF THE INVENTION

For purposes of summarizing the invention, certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

In one embodiment, the present invention includes an internal combustion engine valve actuation system comprising: (1) a valve rocker; (2) a camshaft having an opening lobe and a closing lobe each rotationally attached thereto; (3) an opening push rod operably associated with the rotation of the opening lobe; (4) a closing push rod operably associated with rotation of the closing lobe; (5) an intermediate rocker to produce the reversing action and (6) a rocker link operably connected at one end to the opening push rod and the closing push rod, and at the other to the valve rocker. In such embodiments, the valve rocker includes an opening rocker arm and a closing rocker arm connected to a valve such that rotation of the camshaft causes the opening rocker arm to open the valve, and further rotation of the camshaft causes the closing rocker arm (which is connected by the adjustment screw to the opening rocker) to close the valve.

DETAILED DESCRIPTION

Figure 1:
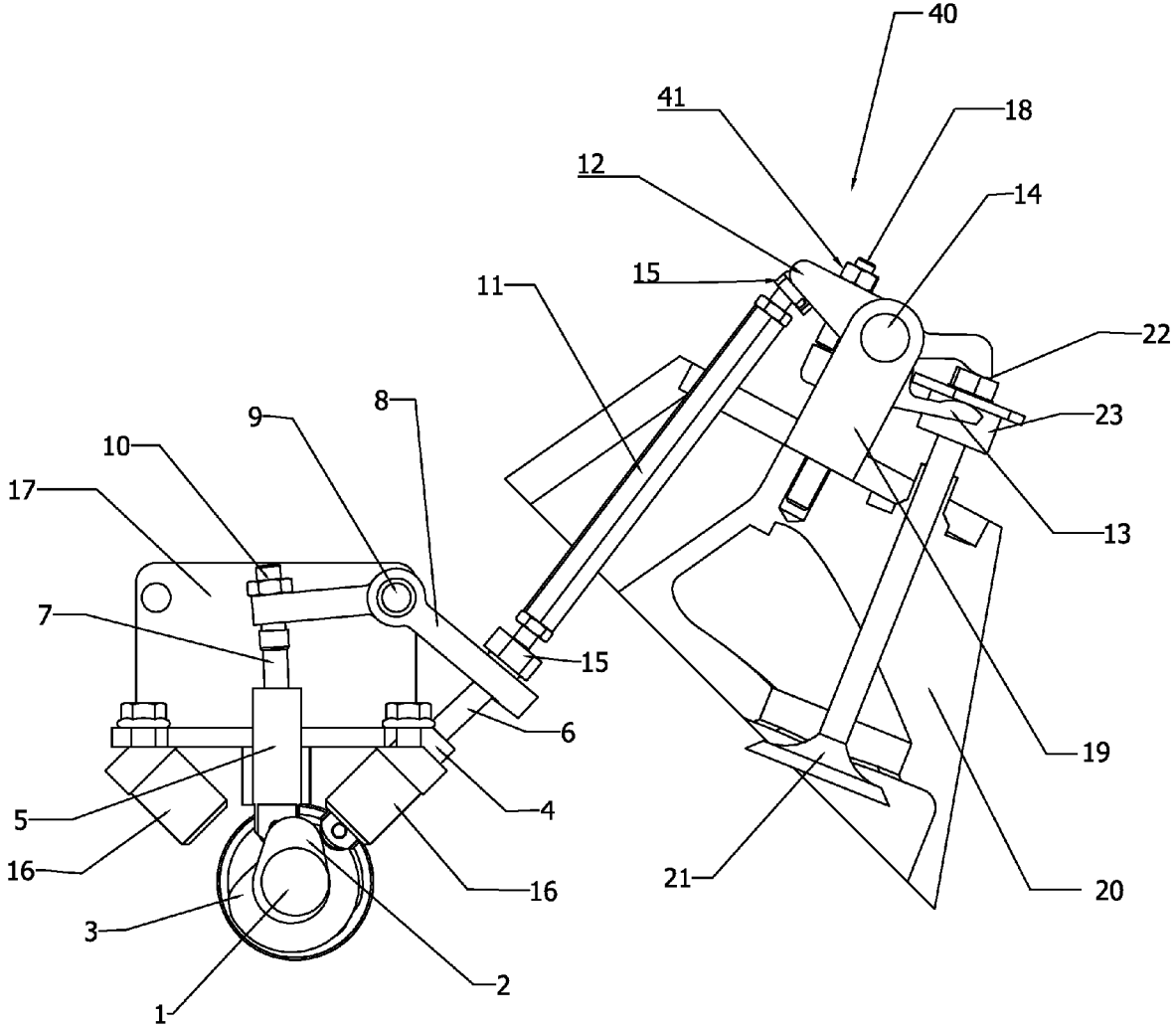
FIG. 1 shows a valve actuation system in accordance with one embodiment of the present invention, illustrating its use with a single camshaft.

The valve actuation system of the present invention is generally directed to use with "push rod" type engines. Among other things, it permits the valves in those engines to operate without many limitations normally associated with spring-actuated valves. Commonly these "push rod" engines are of a V-type configuration where two banks of cylinders are arranged to use a common crankshaft with the cylinder banks at various degree of inclination to the centerline of the crankshaft. The degree of inclination depends on the number of cylinders, with a 90-degree 8-cylinder engine generally considered the most common. The invention will accommodate any push rod engine, but a 90-degree V-8 was chosen to illustrate the invention within the attached drawings. Persons of ordinary skill in the art will understand that the valve actuation system of the present invention is not limited in application to only the "push rod" type engine arrangement, but may be utilized with other engine designs and still be within the scope and spirit of the invention.

The present invention can be practiced by adding or modifying components within a traditional "push rod" design. These can include one or more of the following in combination: (1) a pivoted intermediate rocker connecting a opening lifter and closing lifter to a common rocker link, (2) the rocker link being positioned between the intermediate rocker and (3)

a bifurcated valve rocker that opens and closes a valve, and (4) a means to retain the valve stem to allow the valve to respond (open or close) to the action of the valve rocker. When combined into various combinations, these components provide a modified spring-less desmodromic valve movement.

As indicated above, engine camshafts typically include one or more lobes. By way of example but not by way of limitation, the embodiments of the present invention shown in the accompanying drawings illustrate lobes on a camshaft. In the embodiments of the invention illustrated in the drawings, as the camshaft rotates or spins, the lobes open and close the intake and exhaust valves. The invention can be practiced in a variety of embodiments, including single or dual camshafts. Single camshaft embodiments typically have an opening and closing lobe for each valve. In dual camshafts embodiments, one camshaft typically opens the valve and a second camshaft typically closes the valve. The present invention will first be described in one of its many embodiments, such as it might be used in a single camshaft design.

Figure 8:
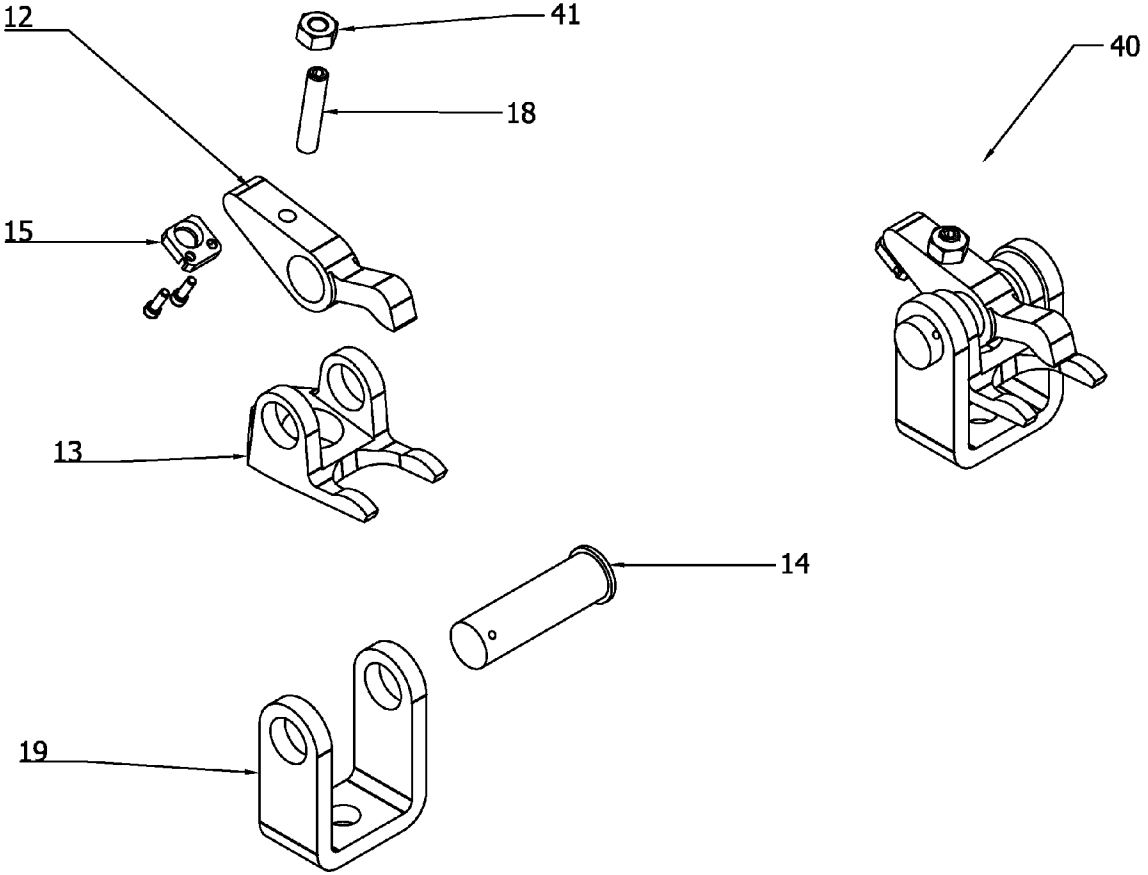
FIG. 8 is an assembly drawing of the rocker assembly showing the component parts in an exploded view on the left side, and their assembled relationship on the right.

As shown in FIGS. 1 and 8, in one embodiment, the valve actuation system of the present invention preferably includes two linkages for each valve, preferably driven by a single camshaft. The first linkage is a "valve opening pathway or linkage" that preferably includes a combination of elements forming a linkage to transmit the rotational motion of the camshaft 1 into a controlled "opening" linear motion of the valve 21. Although any suitable combination of elements can be utilized to accomplish the desired linkage, one embodiment of the invention can include linkage elements such as:

1. a camshaft 1 (shown in an end view within FIG. 1) having a opening lobe 2 rotationally attached thereto;
2. an opening lifter 4 and an opening push rod 6 operably associated with the rotation of the opening lobe 2;
3. a connection of the opening push rod 6 to an intermediate rocker arm 8;
4. a rocker link 11 positioned between upper and lower link attaching sockets 15 (the lower link attaching socket 15 connecting the intermediate rocker arm 8 to the rocker link 11);
5. a valve rocker assembly 40 incorporating an opening rocker arm 12 connected to the upper link attaching socket 15; and
6. the opening rocker arm 12 being pivotally attached to a rocker arm shaft 14 and to the valve 21 on the opposite side of the rocker arm shaft 14 from the rocker link 11. As with the other elements of the linkage, the connection between the opening rocker arm 12 and the valve 21 can be provided by any suitable means (such as the exemplary combination of a lash cap 22 and a compressing flange 23 shown in FIG. 1).

The valve actuation system of the present invention preferably further includes a second linkage for each valve—a "valve closing pathway or linkage". Although the closing linkage is similar to the above-described "opening" linkage (in that it can be provided in any of a wide variety of elements and combinations thereof), it preferably transmits the rotational motion of the camshaft 1 into controlled "closing" linear motion of the valve 21 (in other words, forcing the valve to seat in a closed position). In the embodiment illustrated in the attached drawings, this closing linkage preferably includes the camshaft 1 having a closing lobe 3 rotationally attached thereto, a closing lifter 5 and an closing push rod 7 operably associated with the rotation of the closing lobe 3, an intermediate rocker arm 8 pivotally attached to an intermediate rocker shaft 9 and connected at one end to the closing lifter 5 and at the other end via the lower link attaching socket 15 to the rocker link 11. As previously described, the rocker link 11 preferably is positioned between upper and lower link attaching sockets 15. A valve rocker assembly 40, incorporating the opening rocker 12, having a closing rocker arm 13 pivotally attached to the rocker arm shaft 14, is further included. Similar to the opening rocker arm 12, the closing rocker arm preferably terminates on the lash cap 22 and compressing flange 23 combination interconnecting the valve 21 to the valve actuation system.

Accordingly, in certain embodiments, portions of the valve opening and closing pathways/linkages are operably connected or associated in substantially the same manner. For example, the rocker link 11 connecting from the intermediate rocker arm 8 to the opening and closing rocker arms 12, 13 can be a single element.

Among the many alternative embodiments of the invention (not shown), the rocker arms 12, 13 may be manufactured with roller tipped ends (which is a common racing engine option), rather than the non-roller ends shown in the drawings. The invention can be practiced with those or other types of rocker arm ends.

In a preferred use of the invention, the camshaft 1 rotates, causing rotation of the attached opening lobe 2, in turn causing the opening rocker 12 to move. This movement of the first connected end of the opening rocker 12 is in a first direction (generally toward the upward right as viewed in the drawings). The pivotal attachment of the opening rocker arm 12 on the rocker arm shaft 14 causes the other or second end of the opening rocker arm 12 to move in the opposite direction (to the lower left as viewed in the drawings), which pushes open (or unseats) the valve 21 (by way of the valve's connection to the opening rocker arm 12 via the lash cap 22 and compressing flange 23 combination, or some similar linkage structure).

Further rotation of the camshaft 1 and the associated closing lobe 3 causes the opening rocker to move in a direction opposite to the above-described directional movement caused by the opening lobe 2 (in other words, closing lobe 3 causes the rocker to move toward the lower left as shown in the drawings). In turn, the first end of the closing rocker arm 13 is likewise moved toward the lower left (due to the contact between the opening rocker and closing rocker provided by the closing valve adjustment screw 19 and locking nut 41), causing the arm 13 to pivot on the rocker arm shaft 14, which causes the second end of the closing rocker arm 13 to move toward the upper right as shown in the drawings. This in turn closes or seats the valve, by way of the valve's connection to the second end of the closing rocker arm 13 (via the lash cap 22 and compressing flange 23, or some similar connection).

Accordingly, one embodiment of the invention uses the valve rocker assembly's 40 pivotal attachment to the rocker arm shaft 14 and its unique design configuration to both open and close a single valve 21. This dual role of the valve rocker assembly 40 is made possible by the valve rocker assembly 40 (*a*) being attached to a rocker link 11 that is jointly associated with both the opening push rod 6 and the closing push rod 7, and (b) having a bifurcated "second" end that includes both an opening rocker arm 12 and a closing rocker arm 13 positioned on opposite sides of the lash cap 22 and compression flange 23 combination. As such, linear reciprocating movement of the rocker link 11 in one direction is transmitted through the opening rocker arm 12, to the closing rocker arm 13, causing them to move/reciprocate in the opposite direction (to either open or close the associated or corresponding valve 21).

For example, as the opening cam lobe 2 pushes against the intermediate rocker arm 8 (forcing it toward the upper right direction in the drawings), the valve 21 opens as in the conventional "push rod" engine. When the opening lobe 2 has reached the end of its opening duration and begins to descend, the closing lobe 3 begins to push against the opposite side of the intermediate rocker arm 8 to pull the rocker link 11 down (in the lower left direction in the drawings), thus closing the valve 21 (by pulling the valve toward the upward right). Accordingly, in contrast to the relatively inactive role of the camshaft and lobes in manipulation of the valve of a traditional "push rod" system (i.e., springs are used to actively manipulate the valve), the camshaft and lobes of the present invention actively engage or manipulate the valve to cause the valve to open and close. The cam lobes 2, 3 preferably are designed with an appropriate shape and offset from each other, so that the closing lobe 3 does not interfere with the opening lobe's action in opening the valve 21, and does not force closed the valve 21 during any desired "delay" in the open position, but then eventually closes the valve 21. Preferably, both lobes 2 and 3 are also shaped and aligned with respect to the other lobes on the camshaft 1 (for the other valves) to keep the valve 21 in the closed position until its next desired cycle of opening/closing.

Figure 9:
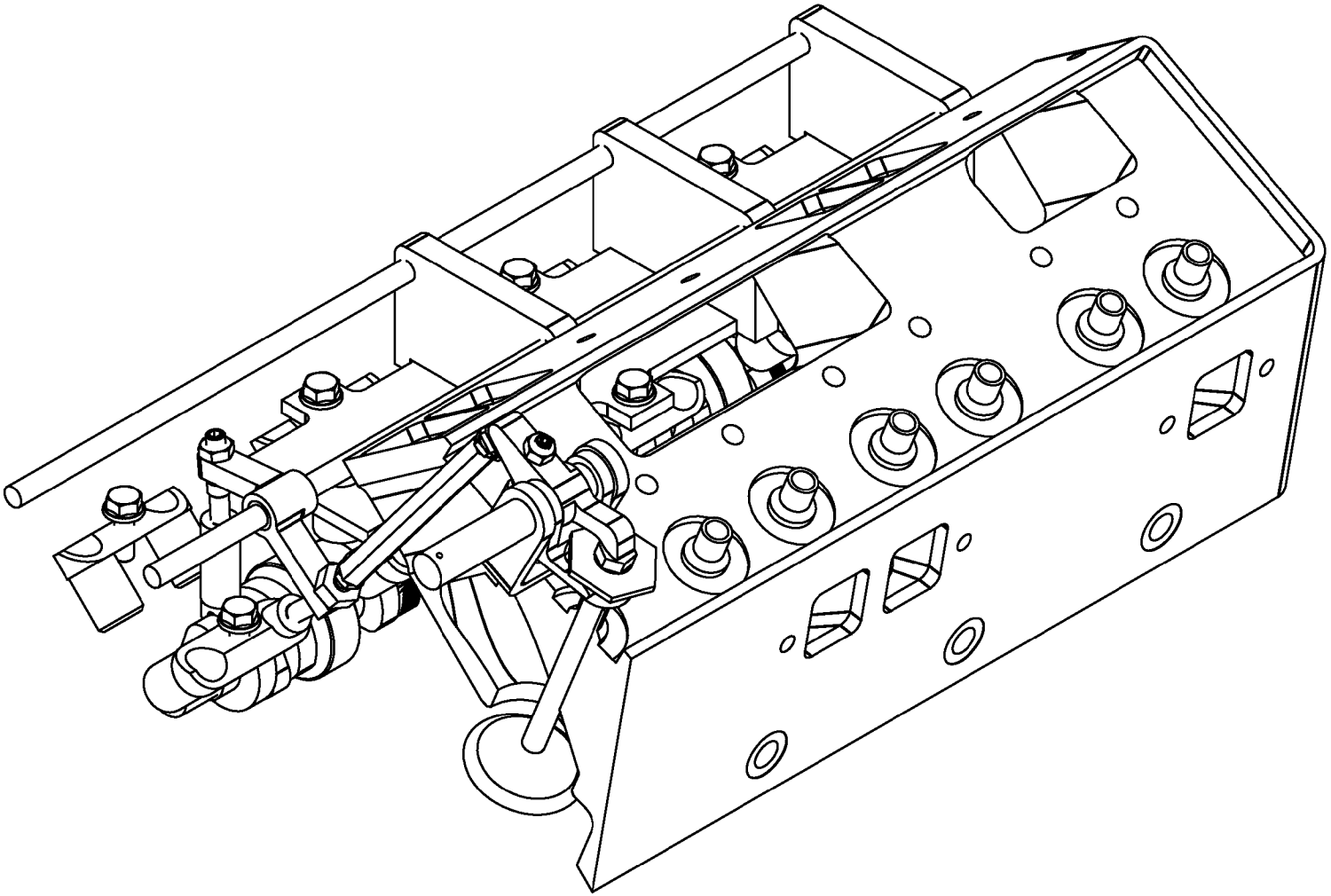
FIG. 9 is a perspective partially cutaway view of the valve actuation system of FIG. 1 and related components of an internal combustion engine assembly in accordance with one embodiment of the present invention.

As shown at least in FIGS. 1 and 9, the valve actuation system of the present invention may further include an opening and closing lifter guides 16 to help align the lobes 2, 3 of the camshaft and provide a means to mount the intermediate rocker 9. In a retro or after market application the lifter guides 16 provide a lifter bore to house the closing lifter 5 that is not provided in the original configuration of the engine casting. If the present invention were manufactured as original equipment, incorporation of the closing lifter bore and mounts for the intermediate rocker shaft 9 would be cast into the engine block and the separate lifter guides 16 would not be necessary.

An intermediate rocker adjuster 10 and a closing valve rocker adjuster 18 are preferably included to create clearances so that the components do not bind between the opening and closing events. Depending on other factors, if hydraulic (self-adjusting) lifters (not shown) are provided the adjusters may not be needed. A rocker yoke 19 for attaching or connecting the rocker arm shaft 14 to the engine's cylinder head 20 is preferably further included.

Some of the other figures illustrate a few of the many alternative embodiments of the invention, including some slight modifications that can be made to adjust the valve opening distance or other parameters. For many or most applications, a larger valve opening distance is preferable as it will improve engine performance. There are physical limitations throughout any engine and valve system that can constrain the opening distance (including within the piston chamber, within the cam bore, and other locations). The invention can be modified to adjust that valve opening distance, including by some of the techniques discussed and shown in some of the alternative embodiments.

Figure 2:
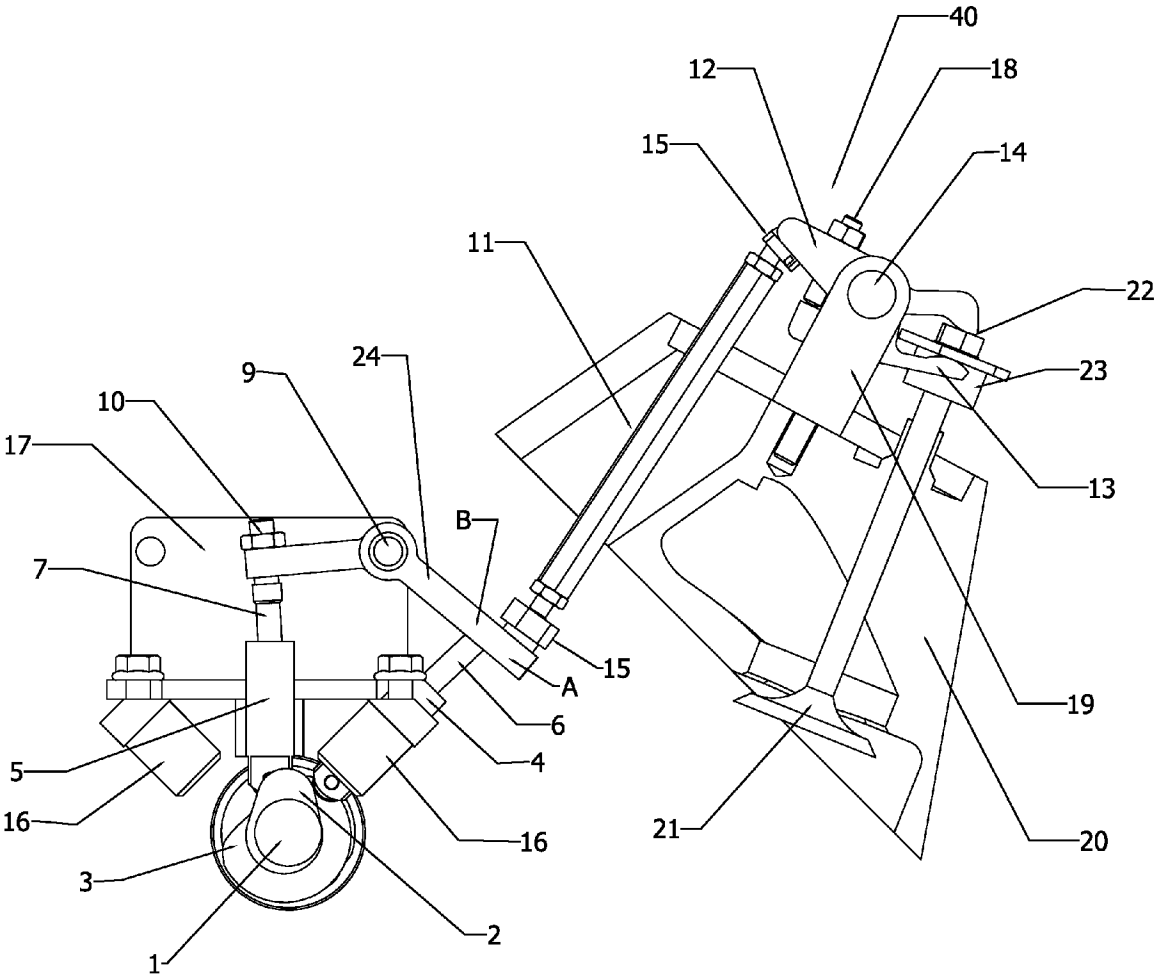
FIG. 2 shows an alternative embodiment of the valve actuation system of FIG. 1, in which the length of the intermediate rocker is extended (as compared to its length in FIG. 1), to increase the distance the valve opens or extends into the cylinder.

For example, in FIG. 2, the length of the intermediate rocker 24 (designated at reference "A") may be extended (as compared to its length in FIG. 1) to permit attachment of the rocker link 11 a further distance from the intermediate rocker shaft 9. In this embodiment, the contact location of the opening push rod 6 or lifter 4 with the intermediate rocker 24, designated at reference "B" in FIG. 2, remains the same, as does the timing and duration of lobes 2, 3 on each of the lifters 4, 5. Positioning of the rocker link 11 in this manner increases the distance the valve 21 opens or extends into the cylinder 20, without having to increase the lift provided by the cam 1. In this regard, increasing the lift at the cam 1 may be a problem since the cam 1 typically has a limited working diameter.

Figure 3:
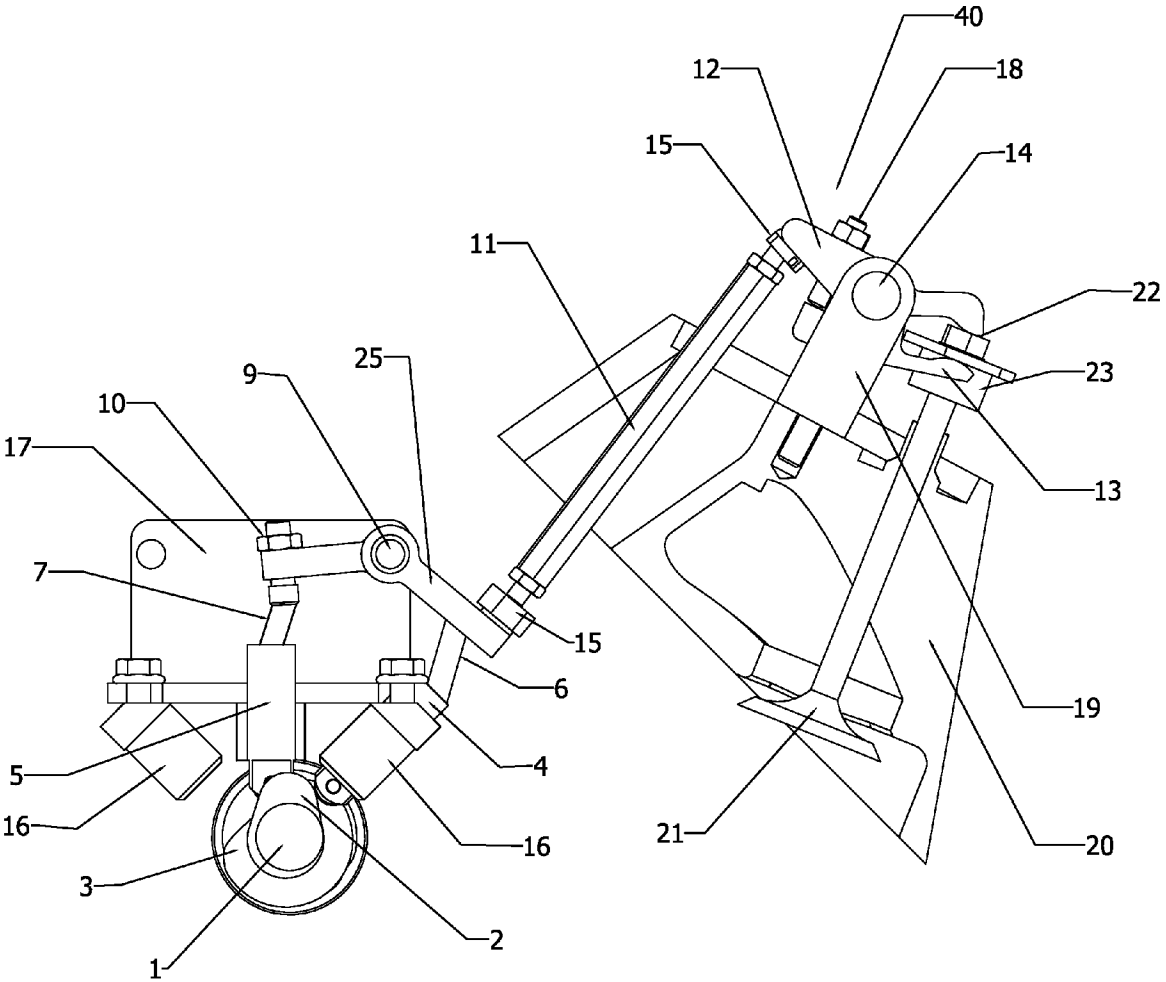
FIG. 3 shows another embodiment of the valve actuation system of the present invention which also can increase the distance the valve opens or extends into the cylinder, by moving the contact point of each push rod, or lifter with the intermediate rocker toward the pivot point (i.e., toward intermediate rocker shaft).

A further alternative embodiment shown in FIG. 3 can be used if an increase in the distance of the valve opening is desired and space is not available to extend the length of the intermediate rocker 24 (as described above in connection with FIG. 2). Instead, and as shown in FIG. 3, the contact point of each push rod 6, 7, or lifter 4, 5 with the intermediate rocker 25 may be moved toward the pivot point, i.e., intermediate rocker shaft 9 of the intermediate rocker 25 to effect such a change in valve opening distance.

Figure 4:
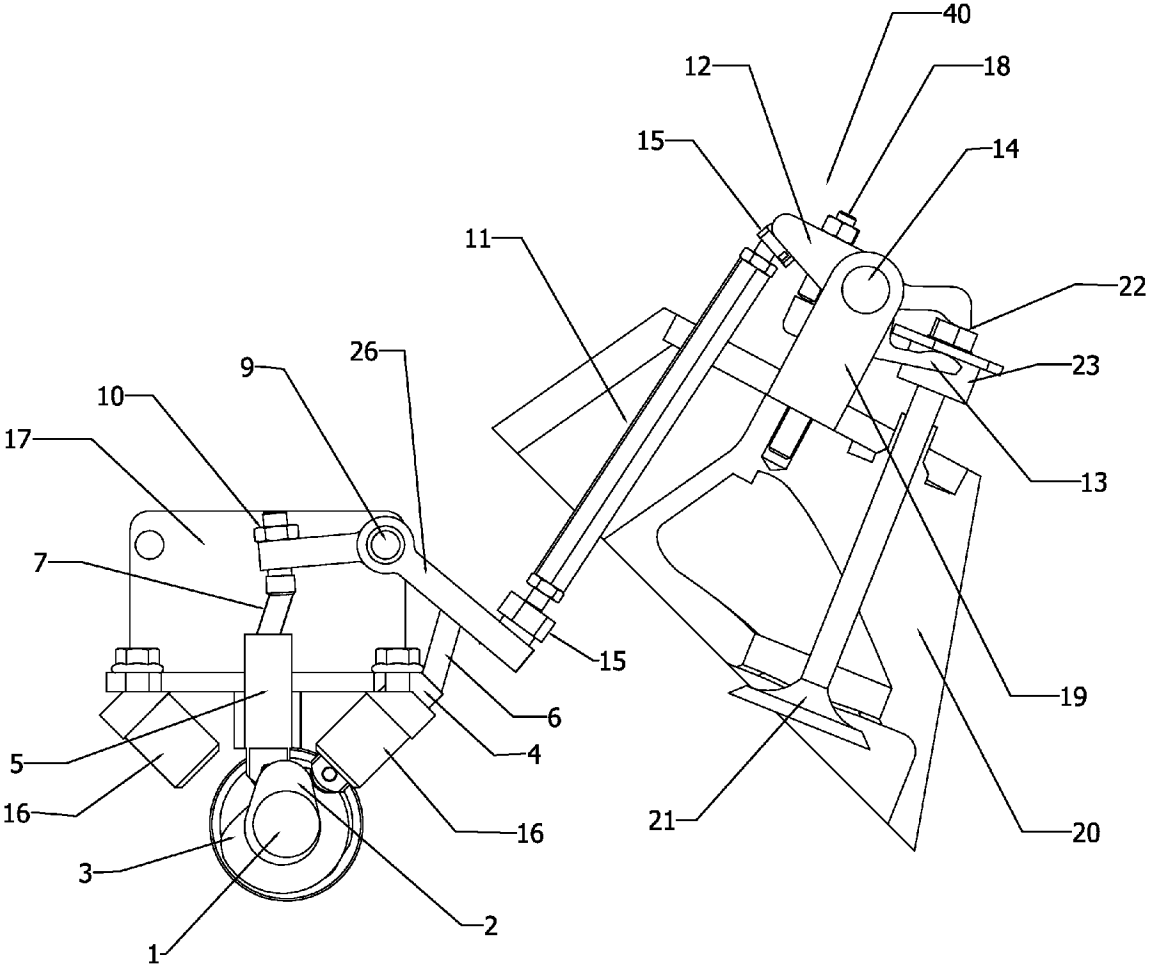
FIG. 4 shows still another embodiment of the valve actuation system of the present invention.

FIG. 4 depicts changes in both the contact points of the opening and closing push rods 6, 7 and lifters 4, 5 with the intermediate rocker 26, and the attachment point of the rocker link 11 along an extended length of the intermediate rocker 26. These design changes would result in the greatest change (as compared to FIG. 1) in the valve opening distance or ratio between the camshaft lift and valve opening distance. As such, the increased valve lift will produce greater volumetric efficiency. Among other things, the alternative embodiments depicted in FIGS. 2, 3, and 4 are among those that can allow designers maximum latitude to adapt the invention to the wide variety of "push rod" engines produced around the world. For example, the Chevrolet small block V-8 engine has been produced in its basic configuration since 1955 with a 2 inch camshaft diameter. To achieve the maximum lift with that diameter the camshaft designer may choose an embodiment similar to that shown in FIG. 4. The newest small block V-8 engine from Chevrolet (RO-7) was designed for racing and has a 3 inch camshaft diameter and the designer could choose from the other available embodiments (since the camshaft diameter in that newest small block V-8 is adequate to create high lift at the camshaft).

Figure 5:
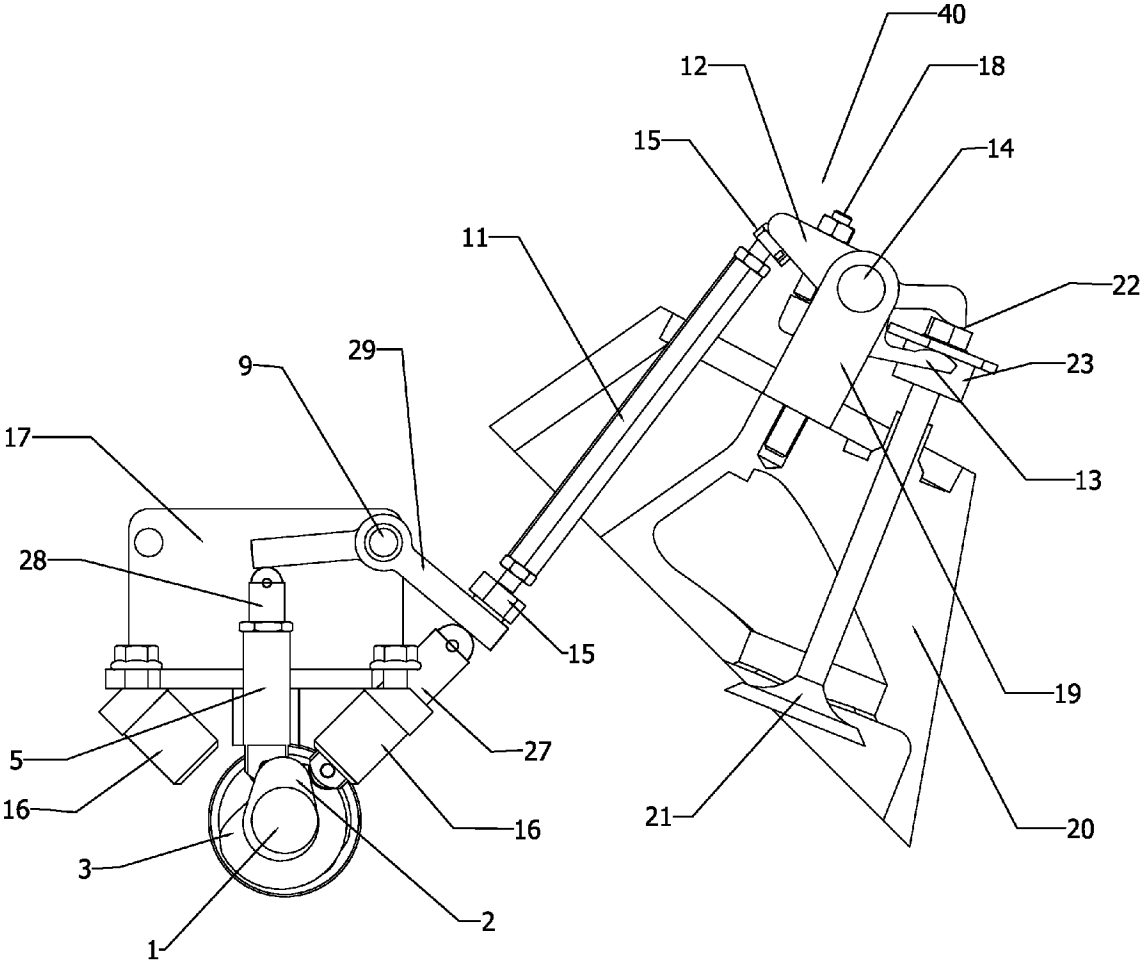
FIG. 5 shows another embodiment of the valve actuation system of the present invention.

In another alternative embodiment, shown in FIG. 5, the opening and/or closing push rods 6, 7 may be eliminated if the opening and/or closing lifters 27, 28 are designed to push directly on a modified intermediate rocker arm 29. In this regard, the lifters 27, 28 preferably have rollers positioned at both ends.

Persons of ordinary skill in the art will understand that lifters of all common and well-known designs may be used with the present invention including, mechanical (also called solid), hydraulic, roller and flat tappet lifters. Presumably the present invention will also be useful in future (not yet known) designs of lifters and other elements.

Figures 6, 6A, 6B, 6C:
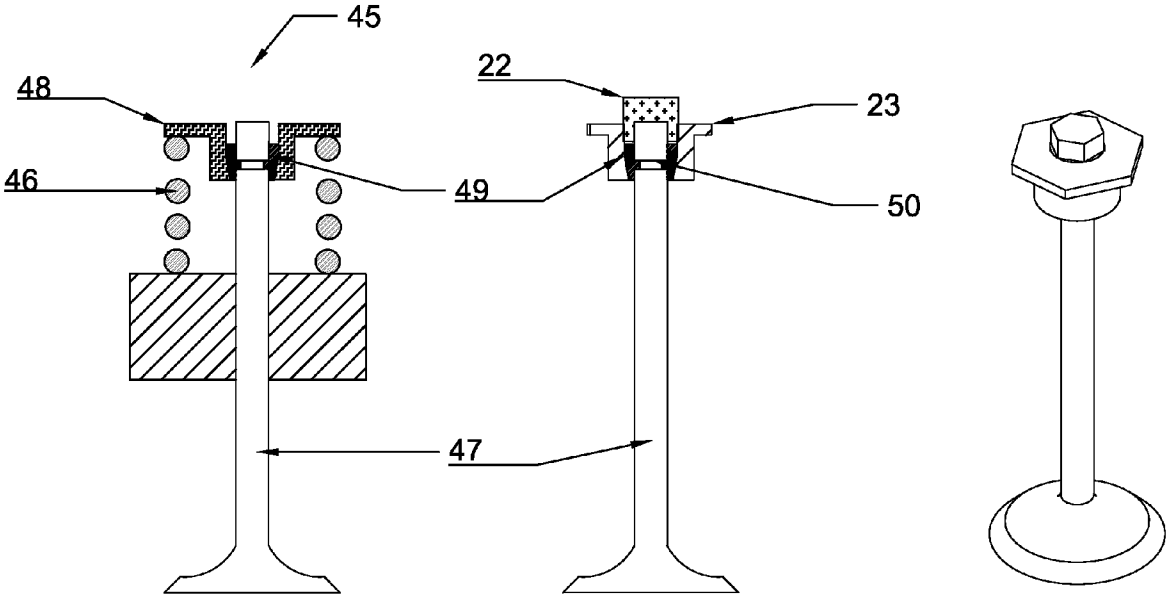
FIG. 6A shows a prior art valve and related elements.
FIGS. 6B-6C shows a valve and the valve's association with a lash cap and compressing flange in accordance with one embodiment of the present invention.

FIG. 6A shows a prior art spring-actuated valve system 45 configuration generally used in known "push rod" type engines. These systems are not desmodromic in nature, and require a compressed valve spring 46 to maintain valve 47 contact with the cam lobe (not shown), and further require a valve spring retainer 48, and valve keepers 49. As shown, upward pressure of the compressed valve spring 46 keeps the valve keepers 49 locked in a groove 50 (or in some cases three smaller semi-circular grooves). The valve keepers 49 are designed to wedge themselves against an upper portion of the valve stem. This type of valve system configuration has been utilized for over 100 years and nearly all-conventional "push rod" type engines employ such an arrangement.

Because the valve system of the present invention is intended (among other things) for use with current and past production engines of the "push rod" design (where the valves are of an existing commercial design), unique valve designs or configuration preferably are not necessary. Instead, FIGS. 6B and 6C show one embodiment of the valve actuation system of the present invention including the valve 21, lash cap 23 and compressing flange 22 combination. As can be seen from comparison to the "prior art" valve in FIG. 6A, the "same" valve can be used to practice the invention (albeit without the spring element 46).

The present invention also has many advantages over known desmodromic valve systems. For example, those systems typically require specially produced valves for application with the desmodromic system. Some known desmodromic systems allow the keepers and retainer (of the compressed valve spring design) to float between the push-pull cycle of a desmodromic design, which could create wear and eventually lead to system failure. Other known systems incorporate a "helper" spring (Ducati motorcycles for example) to maintain contact and avoid wear until the engine reaches operating temperature and the proper clearance between components is reached (which may be desirable for non-racing applications where the engine is not preheated and is easily adaptable to this invention).

A common problem for the valves (particularly the exhaust valves) of internal combustion engines is heat. The common solution is to make the valves from non-carbon metals such as stainless steel and Inconel®, a family of high strength austenitic nickel-chromium-iron alloys that have exceptional anti-corrosion and heat-resistance properties. While these alloys are excellent in high heat, they cannot be heat-treated to the hardness of carbon steels and therefore are prone to wear on the end of the valve stem where the rocker pushes against the valve. A solution for this problem (at least in high performance engines) is the use of "lash caps". These preferably are hardened carbon steel caps, which are pressed on the end of the valve stem to take the wear from the end of the rocker arm pressing against it. Accordingly, although many benefits of the invention can be realized in embodiments that do not include "lash caps", a preferred embodiment of the present invention includes a lash cap 22 and compressing flange 23 combination made from carbon steel and appropriately hardened. The lash cap 22 and compressing flange 23 are preferably threaded together to compress the valve keepers 44, so that there is no movement between those components. The compressing flange 23 is preferably designed with hexagon shaped facets or other means to permit tightening of the compressing flange 23 and the lash cap 22 against each other. As will be appreciated by persons of ordinary skill in the art, the invention can be practiced with any of a wide variety of elements and combinations of elements in place of the lash caps and compressing flanges, or with no lash caps at all.

It will also be appreciated by persons of ordinary skill in the art that the design of lash cap 22 and compressing flange 23 illustrated in the attached drawings would be an advantage in a conventional "push rod" design engine. In such an engine, if a conventional rocker arm should become loose, due to wear or thread disengagement, the rocker can move from its position over the valve stem 21 and push on the retainer 48 thereby releasing the keepers 49 from their groove 50 resulting in the valve dropping into the cylinder creating catastrophic damage to the engine. Since the lash cap 22 and compressing flange 23 are threaded together and capture the keepers 49, an errant rocker arm could not release the keepers 49 from their groove 50 on the valve stem 47 and the valve would remain captured and safe from falling into the cylinder.

In the illustrated embodiments of the present invention there preferably are no geared rockers, but instead only a single rocker arm assembly to open and close a single valve. However, persons of ordinary skill in the art will understand that the present invention can be used within a "hybrid" approach by using both gears and linkages such as described above. For example, it would be possible to alter Motes' design (mentioned above) to incorporate a second closing lifter in a separate bore and use Motes' geared rockers. Other approaches (not shown) could likewise include a second lifter bore and/or camshaft.

Figure 7:
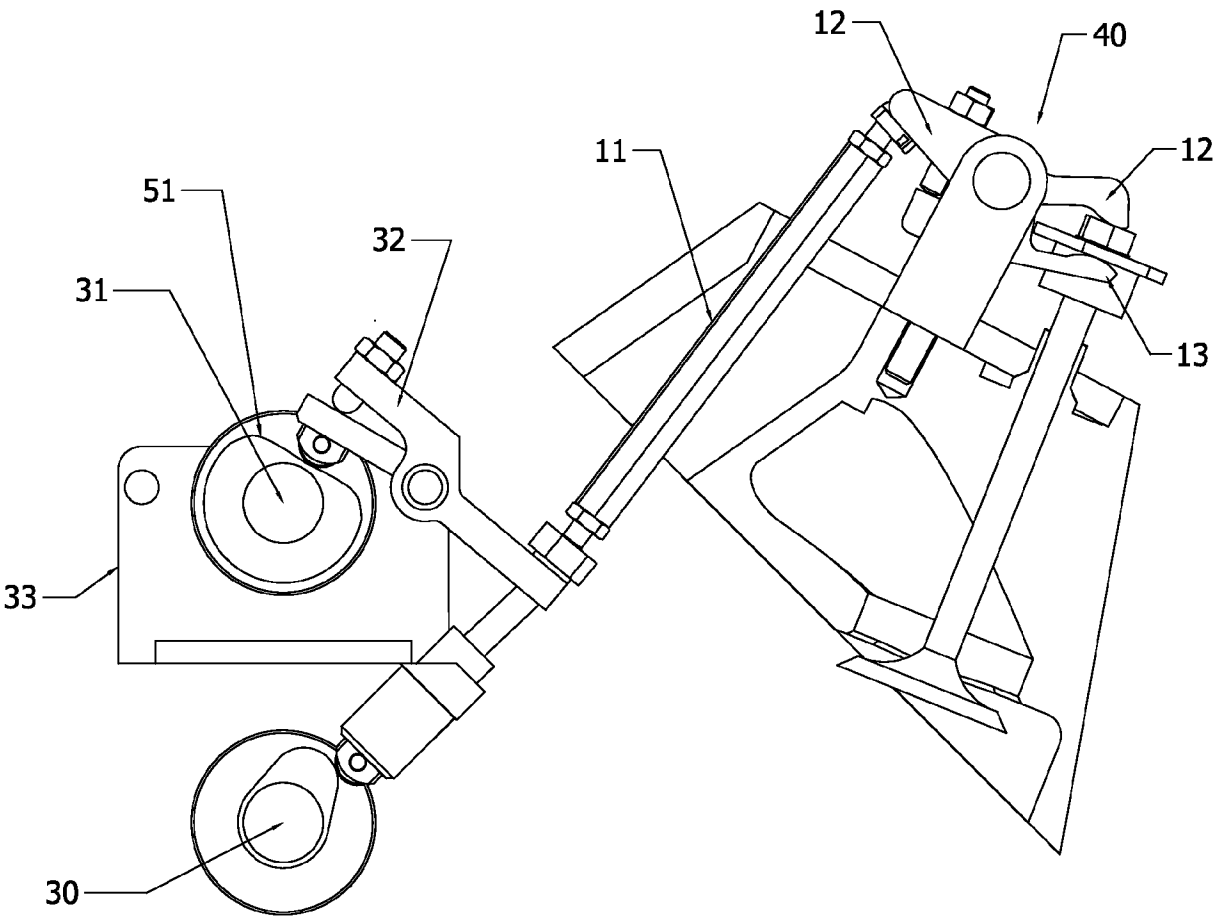
FIG. 7 shows a valve actuation system in accordance with another embodiment of the present invention, illustrating its use with a dual camshaft.

In certain embodiments of the present invention, the lifters are not split and only one lifter occupies the existing lifter bore, and an entirely separate lifter bore is created for the closing lifter as shown specifically in FIGS. 1-5, or an additional camshaft/s as shown in FIG. 7. In this regard, either lifters or camshaft(s) act upon the intermediate rocker 8 to create the opening and closing motion transmitted through the rocker link 11 to the valve rocker 40, incorporating the opening rocker arm 12 and closing rocker arm 13. In the present invention, and as discussed above, a conventional valve preferably is used. The opening rocker arm 12 pushes down on top of the lash cap 22 to open the valve, and the closing rocker arm 13 (separate fork) pushes up on the compressing flange 23 to close the valve. As further discussed above, one embodiment of the present invention is characterized by an intermediate rocker 8, rocker link 11, bifurcated or forked valve rocker 40, and lash cap 22 and compressing flange 23 combination.

One of the many alternative embodiments of the invention (one of its many dual camshaft configurations) is shown in FIG. 7. Persons of ordinary skill in the art will understand that, in other embodiments (not shown), additional camshafts could be utilized in a similar manner. Generally, most of the components as described herein in relation to the single camshaft 1 of the present invention preferably remain essentially the same, except that a second camshaft 31 may be used. This can be helpful in a variety of situations and applications, such as where there is not enough space available for the closing lifter 5. In this scenario, a first camshaft 30 is designated to open the valve 21 and a second camshaft 31 is designated to close the valve 21. The camshafts 30, 31 preferably are timed together by gears, chains, or belts so that the opening and closing events are precise and synchronized. The lobes 51 of the second camshaft 31 act directly upon a modified intermediate rocker 32 since the closing lifter 5 is not needed. The rocker and guide assembly 7 is replaced with a camshaft support assembly 33. Among other things, the dual cam design 30, 31 can incorporate the ratio change features (modification of intermediate rocker 32 and repositioning of opening push rod 6 and/or closing push rod 7 along the intermediate rocker 32) shown in FIG. 2, and/or use of roller lifters 27, 28 described relative to FIG. 5.

Persons of ordinary skill in the art will understand that other varieties of "push rod" engine designs exist, for which it may be appropriate or useful to use embodiments of the invention (not shown) having more than two camshafts. These engines would still preferably use the linkage concepts discussed above (such as via the other major components described above) to achieve the desired "desmodromic" valve control.

The apparatus and methods of the invention have been described with some particularity, but specific designs, constructions and steps disclosed are not to be taken as delimiting of the invention. Obvious modifications will make themselves apparent to those of ordinary skill in the art, all of which will not depart from the essence of the invention, and all such changes and modifications are intended to be encompassed within the appended claims.

What is claimed is:

1. An internal combustion engine valve actuation system comprising:

a valve rocker assembly;

at least one camshaft having an opening lobe and a closing lobe each rotationally attached thereto, an opening push rod operably associated with the rotation of the opening lobe;

a closing push rod operably associated with rotation of the closing lobe;

a direction reversing fulcrum to provide the reversing action, and a rocker link operably connected at one end to the direction reversing fulcrum, and at the other to the valve rocker assembly, the valve rocker assembly including an opening rocker arm and a closing rocker arm connected to a valve such that rotation of the camshaft causes the opening rocker arm to open the valve, and further rotation of the camshaft causes the closing rocker arm to close the valve.

2. The system of claim 1, including at least two such camshafts.

3. The system of claim 1, further including a gear linkage to actuate movement of the valve.

4. A method of controlling the valve action on an internal combustion engine, including providing a system of claim 1, and rotating the at least one camshaft.

5. A method of retrofitting an internal combustion engine, including the steps of providing an internal combustion engine having non-desmodromic valve actuation, and modifying that engine to incorporate a system of claim 1.

* * * * *